United States Patent [19]

Wurscher et al.

[11] 4,147,341

[45] Apr. 3, 1979

[54] CARD FEEDER DEVICE

[75] Inventors: Horst Wurscher, Wilnsdorf; Gerhard Brenner, Freudenberg-Niederndorf, both of Fed. Rep. of Germany

[73] Assignee: U.S. Philips Corporation, New York, N.Y.

[21] Appl. No.: 766,661

[22] Filed: Feb. 8, 1977

[30] Foreign Application Priority Data

Feb. 19, 1976 [DE] Fed. Rep. of Germany ..... 2606697
Mar. 12, 1976 [DE] Fed. Rep. of Germany ..... 2610395

[51] Int. Cl.[2] ..... B65H 3/52

[52] U.S. Cl. ..... 271/122; 271/4; 271/64; 271/125; 271/127

[58] Field of Search ..... 271/4, 3, DIG. 9, 127, 271/125, 122, 160, 167, 109, 264, 64

[56] References Cited

U.S. PATENT DOCUMENTS

| | | | |
|---|---|---|---|
| 878,614 | 2/1908 | Dick | 271/127 X |
| 3,218,060 | 11/1965 | Harbison | 271/4 |
| 3,598,396 | 8/1971 | Andrews et al. | 271/9 |
| 3,755,653 | 8/1973 | Venker | 271/4 X |
| 3,776,545 | 12/1973 | White | 271/4 |
| 4,030,722 | 6/1977 | Irvine et al. | 271/125 X |

*Primary Examiner*—Bruce H. Stoner, Jr.
*Attorney, Agent, or Firm*—David R. Treacy

[57] ABSTRACT

A feeder device having a supply magazine for record carriers and an associated separating device. The magazine is pivoted to bring a top sheet into contact with a feed roller, and the pivot motion is used to control the separating device so that more reliable separation is obtained.

5 Claims, 4 Drawing Figures

CARD FEEDER DEVICE

BACKGROUND OF THE INVENTION

The invention relates to a feeder device having guide channels for supplying a record carrier to a processing station, for example in an accounting or computing machine, and ejecting a processed card.

Feeder devices of this general type usually feed individual manually supplied record carrier cards or sheets automatically to the printing area and eject them again after processing. The feed channel and ejection channel are identical so that the record carrier can be taken out manually from the place to which it had been supplied to the feeder device. For feeding the record carrier, feed funnels are provided which can be moved laterally so that the feeder device can be adjusted to different formats of the record carrier. However, the feeding of a new record carrier can take place only when the processed record carrier has been taken out of the feeder device.

However, often a plurality of record carriers are to be processed successively, for example, when the interest percentage or interest has to be calculated for all banking accounts or when other processes recurring at regular intervals have to be carried out. In such cases the record carriers have had to be fed manually one after the other, or different printing devices with sheet-separating devices had to be used. The separating devices were provided as separate additional apparatus to the accounting or computing machines.

SUMMARY OF THE INVENTION

An object of the invention is to provide an attachable feeder apparatus with which, in addition to the known operational processes which so far were carried out manually, these processes can also be performed fully automatically, if desired, while the construction of the apparatus is kept simple.

Another object of the invention is to provide an automatic carrier feeder which reliably separates sheets or cards without requiring a level stack elevator.

Still another object is to prevent the development of flat spots on braking rollers in a sheet separating means.

In accordance with the invention, a feeder device has a supply magazine for receiving a stack of record carriers and a separating device associated therewith, for feeding separated carriers to a second guide channel which may be detachably coupled above a processing station, at least the bottom of the magazine being pivoted about an axis of rotation arranged near or at the center of gravity of the bottom of the magazine so that a predetermined comparatively light engagement force of the uppermost record carrier against a first feed roller is provided independent of the height of the stack of record carriers, and a member coupling the magazine to the separating device so that pivoting of the magazine controls the separating device in a way that provides reliable separation.

In a preferred embodiment, several transport rollers and associated brake rollers follow the feed roller in the direction of feeding, the rollers having locking mechanisms operating in such manner that the separated uppermost record carrier is transported further, while underlying record carriers are retained because the braking rollers do not rotate in the transport direction. The coefficient of friction of the transport rollers is larger than that of the braking rollers in order to ensure the separation of the uppermost record carrier. For this purpose, for example, the transport rollers may be provided with a lining of soft rubber having a high coefficient of friction, whereas the braking rollers have a smooth surface of harder rubber. However, in the course of time these would be flattened by wear at the contact surface with the record carrier and hence the coefficient of friction would become larger. In order to avoid this, rollers are used which are connected to the balancing of the magazine and are rotated only by the pivoting movement of the magazine. Advantageously, several braking rollers are used, and a braking plate engages the braking rollers under spring force and is moved by a link in response to pivoting of the bottom of the magazine.

If, during the separation operation of the stack the braking rollers must not be moved, the rotary movement of the bottom of the magazine is advantageously transmitted to the braking plate directly through a link and a pivotally journalled shift lever. In this case the rotation of the braking rollers is performed only when a new stack of record carriers is fed. When on the contrary a slight rotation of the braking rollers is desired during the separation operation in accordance with the height of the stack, in a preferred arrangement the braking plate freely engages a leaf spring and the pivoting of the bottom of the magazine influences the leaf spring by longitudinal movement of the link.

According to a further embodiment of the invention three further transport rollers are arranged at the area of the junction of the magazine and the pile board at the beginning of the another channel in such manner that the record carrier when being fed into the other guide channel is guided between one outer and the central roller and upon ejection is guided between the other outer roller and the central roller. The direction of rotation of all three rollers is the same both upon feeding and upon ejection. Only one of the three rollers can serve as a driving roller since their surfaces are in frictional engagement. To permit ejection to a separate station for manual removal of an individual carrier a deflector is located at a second channel junction below the other channel referred to above. The deflector directs a carrier being ejected either toward the three rollers, for ejection to the pile board, or toward an ejection station for manual removal. Also, when set for the latter function the deflector permits manual insertion of a carrier through a separate feed funnel to the second junction.

The above-described arrangement presents the possibility of feeding a record carrier, if desired, in the usual manner manually, and additionally feeding it individually from a magazine to the processing station. The ejection of a processed record carrier may again occur, alternatively, to a receiver station manually or in a pile board.

When separating from the magazine of the preferred embodiment, the bottom of the pivoted magazine is tilted by the weight distribution of the stack of record carriers in the direction of the feed roller of the associated separating device in accordance with the height of the stack then prevailing. The side of the bottom of the magazine facing the separating device is thus tilted differently throughout the height of the stack so that the feed angle of the uppermost record carrier to the transport track of the separating device varies continuously as the stack height diminishes. As a result of this, the last record carriers of the stack are fed by the feed roller at a comparatively flat angle. The possibility of a double feed is made larger due to too large an individual feed angle with attendent difficulty of separation.

In order to reduce double feed, according to a further aspect of the invention the whole separation device is arranged as an assembly pivotable about an axis at right angles to the direction of transport of the record carriers and is positively connected to the magazine bottom in such manner that the adjacent sides of the separating device and the magazine move uniformly and in opposite directions. Because of the opposed movements the magazine edge contacted by the roller will cover a path which is smaller than the height of the stack. When the two pivot axes are equi-distant from the point of contact between feed roller and topmost carrier, and the magazine and separating assembly are interlinked to pivot through the same angular distances in the same direction, the feed angle for the record carriers becomes independent of the height of the stack. As a result of this, all record carriers are always fed to the transport path at an approximately equal angle.

BRIEF DESCRIPTION OF THE DRAWING

The invention will now be described in greater detail with reference to the accompanying drawing, in which.

DESCRIPTION OF THE PREFERRED EMBODIMENTS

Figure 1:
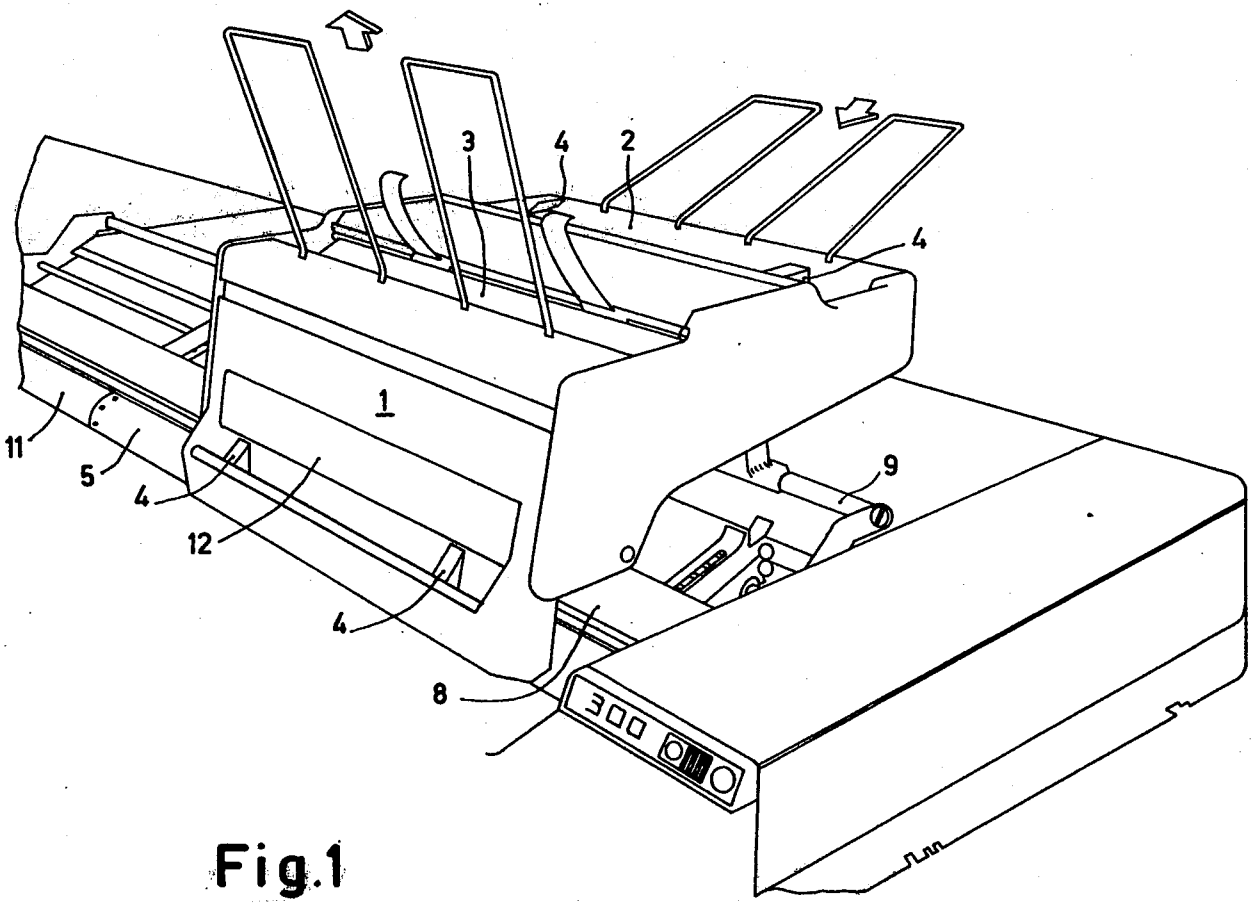
FIG. 1 is a perspective view of the feeder device according to the invention.

The feeder device 1 shown in the figures is arranged on an accounting machine and guided on a slide bar 9 along which it can slide reciprocably in the direction of writing. The feeder device 1 also bears on a sliding rail 8 due to its own weight. The feeder device has format adjusting levers 4, by which a sidewalls of the magazine 2 and of a pile board 3 can be adjusted in known manner, not shown, to the formats of the record carriers to be processed. The feeder device 1 can also be tilted about the bar 9 for easy access to a printing roller 11 and a continuous form 5.

Figure 2:
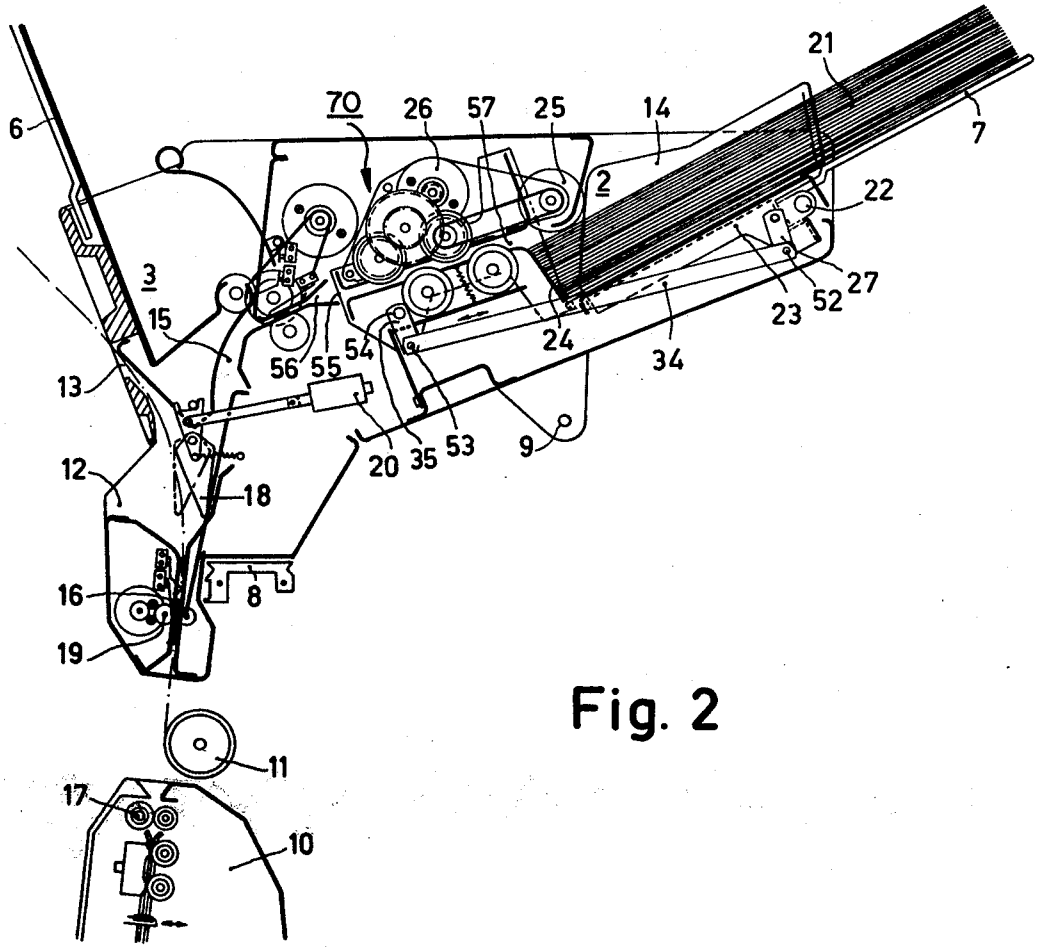
FIG. 2 is a schematic side elevation of the feeder device.
Figure 3:
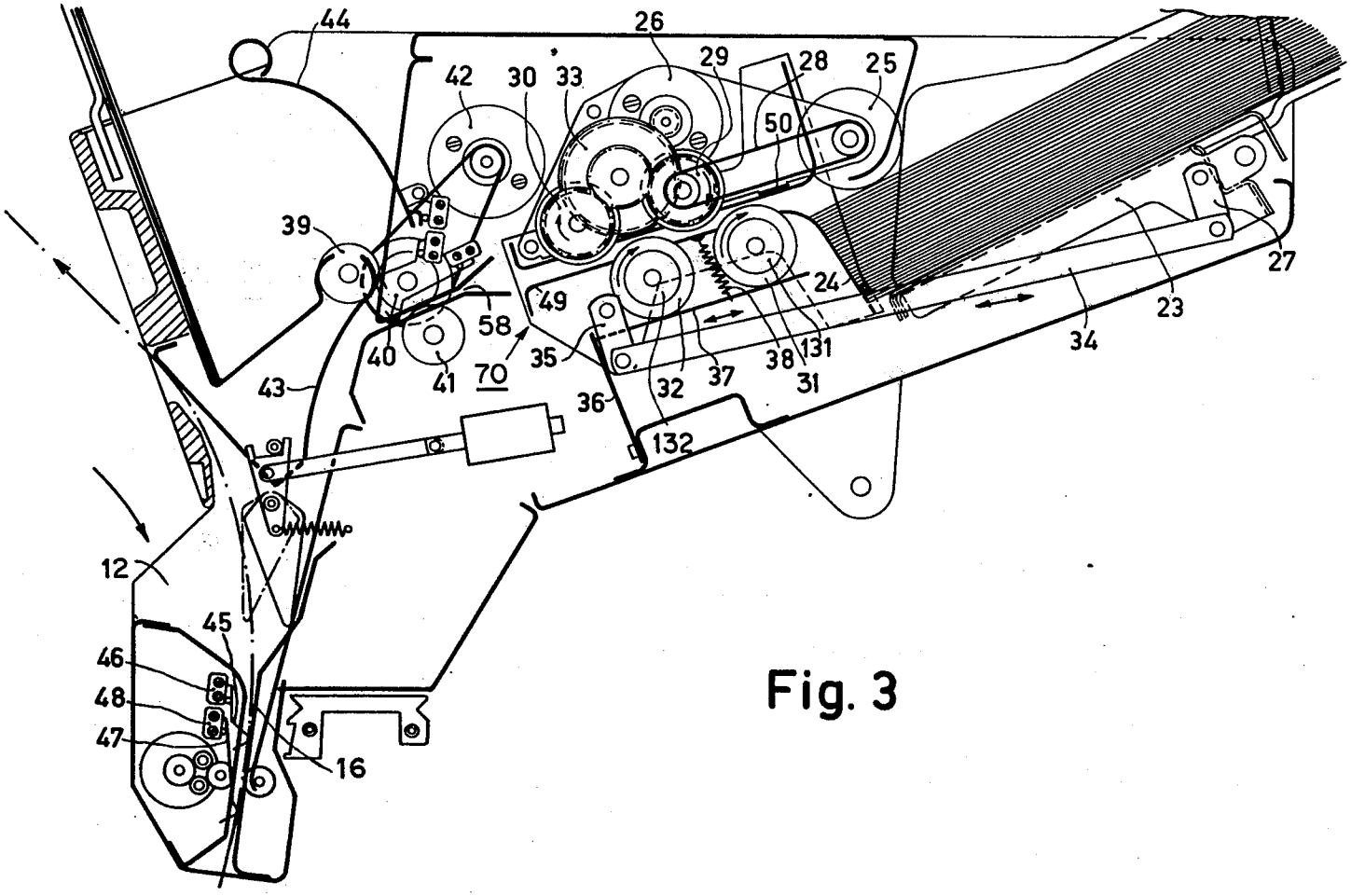
FIG. 3 is a similar view of part of FIG. 2 on a slightly enlarged scale.

As shown in FIGS. 2 and 3, the feeder device 1 has a feed funnel 12 through which a record carrier can be introduced manually into a lower guide channel 16 directed toward a processing station 10. As soon as the record carrier moves a contact lever 45, the feeder device is electrically blocked by an associated microswitch 46 in any known manner for the insertion of a record carrier from the magazine 2, and simultaneously the feed rollers 17 and 19 in the processing station and feeder device, respectively, are switched on. These remain switched on until the record carrier has passed a printing roller 11 and reached the processing station 10. Subsequent ejection of the inserted record carrier is achieved by reversing the direction of the feed rollers 17 and 19. The upper edge of the record carrier slides along the outside of a deflector 18 and is switched to an ejection station 13. After the ejection the record carrier remains above the transport rollers 19 in the station 13 until removed manually. Since in the present example the ejection path to the station 13 is not identical to the feed funnel 12, a new record carrier can be introduced manually while a record carrier is still present in the ejection station 13 but outside the guide channel 16.

The deflector 18 can be moved in any known manner between magazine and manual positions. In the preferred embodiment the deflector is switched by an electromagnet 20 which can be controlled by the machine program to select automatic magazine operation or single card manual feeding and removed.

For control purposes, in the guide channel 16 a further switching lever 47 actuates a microswitch 48 so long as a record carrier is situated in the printing area.

The feeder device 1 includes a supply magazine 2 at the rear for receiving a stack of record carriers 21 and at the front a pile board 3 for storing record carriers ejected while the deflector 18 is set to the magazine position. The pile board 3 is formed partly by the housing of the feeder device and partly by the wire elongations 6 which are rigidly secured to the housing of the feeder device.

The sidewalls 14 of the magazine are arranged so as to be pivotable about the axis of a shaft 22 as well as laterally adjustable by the format adjusting levers 4. The bottom of the magazine 2 is formed by a board 23 which is also pivotally journalled on the shaft 22. Wire braces 7 provide an elongated extension of the bottom board 23. The record carriers 21 bear, under their own weight, against a rigidly secured bent end board 24 extending over the width of the feeder device and serving simultaneously as a sheet guide for inserting the topmost record carrier of the stack 21 into the separating device described below, which is arranged in front of the magazine 2. The bent end 24 is part of a sheet guide 49 which is secured to the sidewalls of an assembly 70 and comprises apertures through which braking rollers 31 and 32 of the separating device project.

The separating device has a feed roller 25 which is driven by an electric motor 26 through a toothed wheel 33, a transport roller 29 and a toothed belt 28. The feed roller is positioned above and in contact with the top sheet of the stack of record carriers 21. The pivoting axis of the shaft 22 is located near the center of gravity of the bottom of the magazine 2 formed by the board 23 and the wire braces 7 in such a position that the topmost record carrier 21 is always pressed lightly from below against the feed roller 25 due to the natural weight of the stack. As a result, movement of the bottom of the magazine in the direction of the feed roller 25 produced by a motor or resilient force (stack elevator) may be omitted.

The separating device succeeding the magazine 2 may have any form; in the preferred embodiment a separating device is provided which is particularly reliable for preventing double feed of record carriers. It consists of two transport rollers 29 and 30 and two braking rollers 31 and 32 which are arranged on either side of the record carrier so as to be staggered with respect to each other in such manner that the common planes through the carrier contact areas of the cylinder surface of the transport rollers 29 and 30 and those of the braking rollers 31 and 32 overlap each other, the surface of the roller of one type intersecting the plane defined by contact areas of the other roller type. The transport rollers 29 and 30 are driven by the electric motor 26 through the toothed wheel 33. The transport rollers are journalled on and positioned to project through apertures of an upper sheet guide 50, secured to the side walls of the assembly 70, in the guides 49 and 50 thus defining a first guide channel 57.

The transport rollers 29 and 30 and the braking rollers 31 and 32 are each provided with a locking mechanism of any known type which permits free movement of the rollers only in the directions shown by the arrows, the freewheel or locking mechanisms 131 and 132 for the braking rollers only being shown schematically in FIG. 3. In addition, the transport rollers 29 and 30 have a higher coefficient of friction with respect to the record carrier than the braking rollers 31 and 32. As a result it is ensured that a record carrier will be separated from any underlying record carrier not preseparated as they pass in the direction of the evaluation or processing station 10. When an underlying record carrier has also been fed when the uppermost record carrier is taken from the stack 21 by the feed roller 25, the first braking roller 31 opposes movement of the underlying carrier in the direction of transport since the record carrier contacting the roller 31 tries to rotate the braking roller in the direction opposite to the arrow, which rotation is prevented by the locking mechanism. At the same time the frictional force of the feed roller 25 acts directly on the uppermost record carrier only. As a result the upper record carrier is moved in the transport direction, while the underlying record carrier is retained by the braking roller 31.

The friction in the feed direction on the uppermost record carrier is intensified as soon as it reaches the first transport roller 29. Since the transport rollers and braking rollers each overlap the above-described plane of carrier contact area by the other, the uppermost record carrier is deflected and hence forces any underlying carrier more strongly against the surface of the braking roller 31. The friction on the underlying record carrier not to be introduced is thereby intensified. In most cases the cooperation between feed roller 25, transport roller 29 and braking roller 31 is sufficient to avoid double feed. For added reliability, however, in the preferred embodiment the same arrangement of transport roller and braking roller is repeated immediately downstream so that during any further transport of an underlying record carrier the same cooperation as described above is repeated. Thus double feed is prevented with certainty.

From the above-described mode of operation it is clear that stationary braking segments might also be used instead of the braking rollers. However, this has the drawback that when such segments have been used for a long period, wear will produce flat spots which will interfere with reliable transport or separation. It is hence advantageous that the braking rollers 31 and 32 can periodically rotate by a small amount.

To reposition the braking rollers, they are controlled by the rotary movement of the bottom board 23 of the magazine 2. As shown in FIG. 3, a swing link 34 is journalled so as to be pivotable about a fixed extension 27 of the bottom 23 of the magazine. The other end of the link 34 is pivotably connected by a bearing 53 to a bar 35 which in turn is journalled to the assembly 70 so as to be rotatable in the proximity of the braking roller 32. A leaf spring 36 engages one end of the link 34 with a pre-load force. During feeding the height of the stack 21 becomes smaller. The bottom 23 of the magazine thus pivots clockwise, as viewed in the drawing, about the shaft 22. Hence the link 34 is moved in the direction of the arrow in small steps (to the left). It moves the leaf spring 36 which in turn permits movement of a braking plate 37 to the left. The braking plate 37 is connected to the lower guide sheet 49 of the separating device by an obliquely positioned tension spring 38 in such manner that the braking plate 37 is pressed against the braking rollers 31 and 32 at the same time that it engages the leaf spring 36 and applies a pre-load force to the leaf spring. When the leaf spring 36 is moved to the left, the braking plate 37 therefore follows the spring movement. The braking rollers 31 and 32 are consequently rotated slightly in the direction of the arrow. After the separation of the record carrier, when a new stack of record carriers 21 is laid in the magazine 2, the bottom plate 23 of the magazine is moved in the opposite direction about the shaft 22. As a result of this the link 34 is moved to the right. The leaf spring 36 is released and follows to the right, taking the braking plate 37. A force opposite to the direction of the rotation arrows is exerted on the braking rollers 31 and 32 which, however, do not rotate in the transport direction because of the locking mechanism. As a result the braking plate 37 slides on the surface of the braking rollers 31 and 32.

Figure 4:
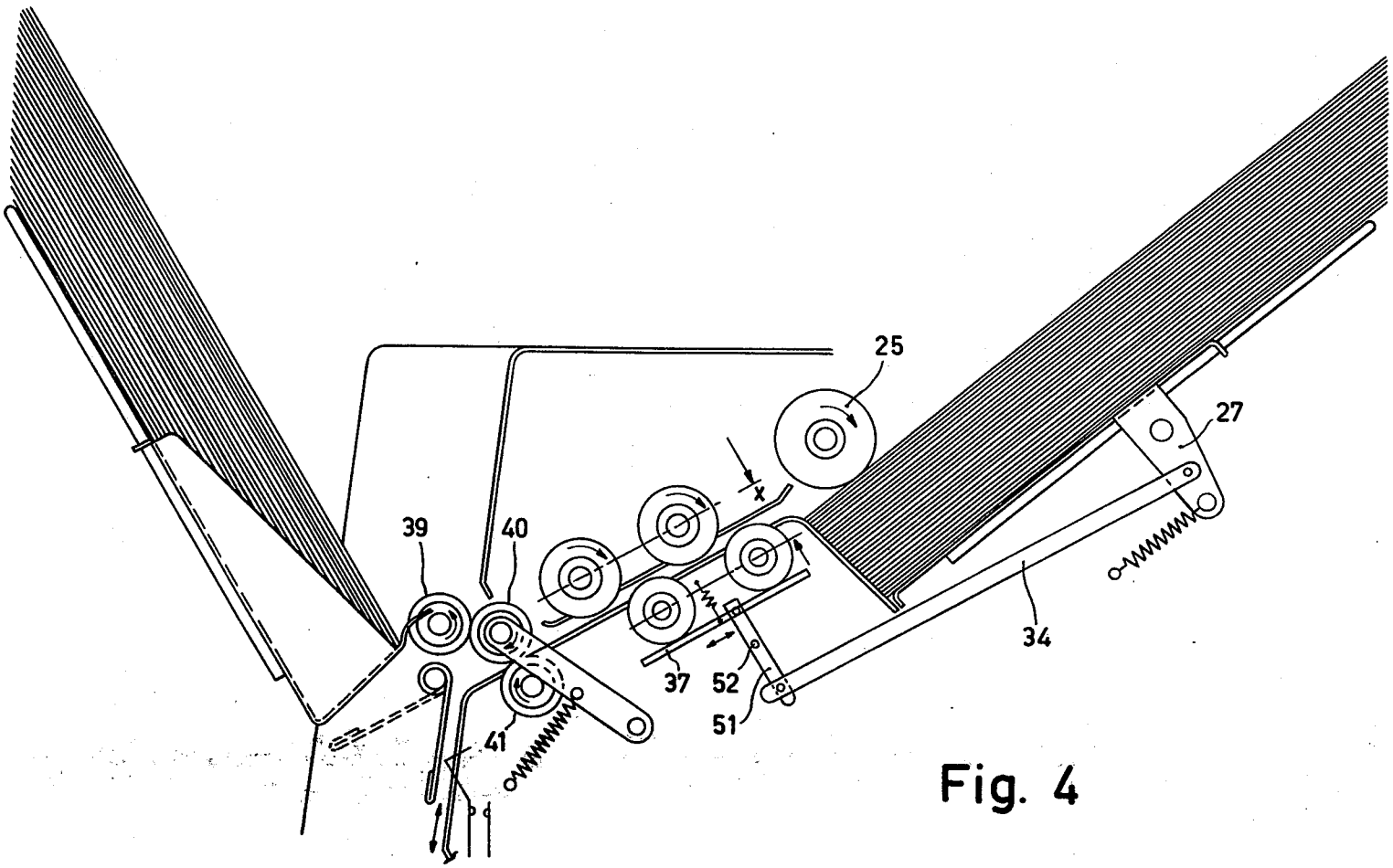
FIG. 4 is a schematic side elevation view of a further embodiment of the control of the braking rollers.

Other ways of controlling the braking rollers are of course possible. For example, as shown in FIG. 4, link 34 can move the braking plate 37 directly. For this purpose an intermediate rod 51 is provided which is pivotally connected to the swing link 34 and to the braking plate 37, and is journalled so as to be rotatable about an axis 52. The leaf spring 36 may be omitted. In such an arrangement the braking rollers 31 and 32 are not rotated during the separation operation, but only then when a new stack of record carriers is laid in the magazine 2.

As described above, transport rollers 29 and 30, as well as the braking rollers 31 and 32 project through sheet guides 49 and 50 forming a first guide channel 57 for the record carriers through the separating device. The exit end 55 of the channel 57 is positioned opposite to the feed funnel 56 of a second guide channel 58 which directs the separated record carrier toward the evaluation station 10, shown in FIG. 2.

The first guide channel 57 determines a carrier path having a comparatively flat angle to the surface of the stack 21, which angle should be chosen to be so that comparatively easy feeding of the upper record carrier by the feed roller 25 is possible, while double feed is avoided as much as possible. The combination of the transport rollers 29, 30 with the braking rollers 31 and 32 should ensure that no double feed into the feed funnel 56 is possible. Since correct feeding requires that there be only a comparatively small range for the feed angle of the uppermost record carrier, if the separation assembly is stationary only a comparatively small height of stack 21 can be separated reliably because the bottom 23 of the balanced magazine pivots about the axis of shaft 22 through an angle corresponding to the change in height of the stack. As a result of this, the lowermost record carriers of the stack 21 are fed at a feed angle which can assume substantially the value 0. This means that as the height of the stack decreases, double feed becomes more and more likely.

In order to avoid this, the separation device which is rigidly mounted with the sheet guide 50 on the assembly 70 can be swung about the axis of a bearing 54. This axis lies near the exit end 55 of the transport path through the separating device so that a carrier being fed always emerges in the proximity of the feed funnel 56 of the second guide channel. The separating device and channel assembly 70 and the magazine 2 are interconnected by the link 34 which as described above is pivotally connected at one end by the bearing 152 to the fixed extension 27 of the balance 23 and at the other end by the bearing 53 to the bar 35. The extension 27 and bar 35 are provided for ease of assembly; it is necessary, as described below, only that the axes of bearings 152 and 53 be so located with respect to the shaft 22 and bearing 54 that the link causes equal pivoting of the magazine and assembly.

In order that the feed roller 25 always supplies the uppermost record carrier of the stack 21 at the same angle to the transport path 57, the distance from the axis of the bearing 54 to the point of contact of the transport roller 25 on the stack 21 must be equal to the distance from that point of contact to the axis of the shaft 22 under the bottom 23 of the magazine 2. As a result the feed roller and the portion of the magazine bottom therebelow move toward each other in equal and opposite directions, while equal pivoting angles of the assembly 70 and magazine 2 assures constant feed angle to the separation device.

After the separation of the uppermost record carrier, the latter is supplied through the second guide channel to the third guide channel 15 at the beginning of which a combination of three transport rollers 39, 40, 41 are provided. This arrangement of transport rollers both feeds the separated record carriers to the lower guide channel 16 and hence to the evaluation station 10, and transports ejected record carriers to the pile board 3 without the direction of rotation of the transport rollers 39, 40 and 41 being changed. To achieve this, the separated record carrier is introduced into the area between one outer transport roller 41 and the central transport roller by corresponding sheet guides forming the second guide channel 58. The central transport roller is driven by an electric motor 42. The speed of transport of the rollers 41 and 40 is arranged to be slightly greater than that of the transport rollers 29 and 30. Within the third guide channel 15 the record carrier is guided by a sheet guide 43. For operation in this mode, by program control of the accounting machine, the electromagnet 20 is energized and the deflector 18 is switched to the magazine position (broken lines).

After processing the record carrier, it can be supplied in accordance with the position of the deflector 18, as described above, either to the ejection station 13 or to the third guide channel 15. The channel 15 is constructed so that the upper edge of the record carrier automatically lands in the area between the other outer transport roller 39 and the central transport roller 40. It is transported further by both transport rollers 39 and 40 and guided into the pile board 3 by a pivotally arranged guide 44. The lower side of the record carrier follows the surface of the outer roller 39.

Advantageously, there is only one separating device arranged in the center of the feeder device. The combination of transport rollers 39, 40 and 41 on the other hand is double and is arranged on either side behind the separating device viewed in the direction of movement of the documents.

Since synchronization of the speeds of rotation of the feed rollers 17 and 19, respectively, and the transport rollers 39 and 40 is not obligatory, the rollers 39 and 40 have a freewheel mechanism which operates in the direction of rotation. When record carrier being ejected into the pile board is supplied by the roller pair 19 at a higher speed than corresponds to the transport speed of the roller 40 driven by the motor 42, a force opposite to the direction of transport would otherwise be exerted on the record carrier when running between the rollers 40 and 39, which may result in buckling or bending or damage of the record carrier. When the rollers 39 and 40 are driven through a freewheel mechanism, for example a locking mechanism similar to that for the transport and braking rollers, they can be rotated more rapidly by the supplied record carrier so long as the record carrier is driven by the pair of rollers 19. The transport speed of the record carrier up to the pile board is afterwards determined by the speed controlled by the motor 42. In the arrangement as shown in FIG. 4 the combination of transport rollers is constructed slightly differently. In this case one of the outer rollers 39 or 41 is driven by a motor not shown. The central roller 40 is forced against the two outer rollers by resilient force. The mode of operation corresponds to that described above.

If for reasons of technical operation it would be desired to use a constantly driven roller 39 for feeding the record carrier to the evaluation station, two rollers 40 are arranged close to each other on the same shaft, one of which is constantly and directly driven by the motor 42 and is connected to the roller 41, while the other roller 40 is driven through a freewheel mechanism by the motor 42 and is connected to the roller 39.

What is claimed is:

1. A record carrier feeder device for supplying a record carrier to a processing station, and having a supply magazine for receiving a stack of carriers; a first guide channel; means for feeding at least one carrier from a stack in the magazine into the guide channel in a direction of transport, said means for feeding including a feed roller; and means for separating carriers so that only one carrier at a time is supplied from the channel, said means for separating including at least one braking roller disposed to contact the carrier fed by said means for feeding, and means for preventing rotation of the braking roller in the transport direction, wherein said device further comprises pivoting means for mounting the magazine so as to urge a topmost carrier of the stack against the feed roller; and said means for separating comprises means for rotating said at least one braking roller in a direction opposite said transport direction responsive to pivotal motion of said magazine.

2. A device as claimed in claim 1 wherein said means for separating comprises a plurality of braking rollers and at least one transport roller arranged alternately in the direction of transport and disposed to opposite sides of the guide channel, carrier contact areas of adjacent braking rollers defining a plane intersected by the transport roller therebetween.

3. A device as claimed in claim 1 wherein said means for rotating includes a braking plate, means for urging said braking plate against at least two adjacent braking rollers and means for moving said braking plate in directions parallel to said transport direction responsive to pivoting motion of said magazine.

4. A device as claimed in claim 3 wherein said means for moving comprises a swing link which moves generally parallel to said transport direction, spring means which engages both said braking plate and said swing link for biasing the plate and link toward the magazine and for connecting the plate to the link for movement responsive to link movement.

5. A device as claimed in claim 3 wherein said means for urging includes a spring arranged to bias the braking plate obliquely toward the braking rollers and in a direction parallel to said transport direction.

* * * * *